US005471859A

United States Patent [19]

Sendzimir et al.

[11] Patent Number: 5,471,859

[45] Date of Patent: Dec. 5, 1995

[54] CLUSTER MILL CROWN ADJUSTMENT SYSTEM

[75] Inventors: Michael G. Sendzimir, Woodbury; John W. Turley, Oxford, both of Conn.

[73] Assignee: T. Sendzimir, Inc., Waterbury, Conn.

[21] Appl. No.: 279,286

[22] Filed: Jul. 22, 1994

Related U.S. Application Data

[63] Continuation-in-part of Ser. No. 917,157, Jul. 20, 1992, abandoned.

[51] Int. Cl.[6] ..... B21B 13/14; B21B 29/00

[52] U.S. Cl. ..... 72/241.4; 72/242.4; 72/252.5; 384/569; 492/39; 29/447

[58] Field of Search ..... 72/199, 237, 240, 72/241.2, 241.4, 242.4, 243.2, 243.4, 243.6, 252.5; 29/447; 384/513, 535, 569, 581; 492/1, 16, 39, 45, 47

[56] References Cited

U.S. PATENT DOCUMENTS

| | | | |
|---|---|---|---|
| 2,169,711 | 8/1939 | Sendzimir | 72/242.4 |
| 2,187,250 | 1/1940 | Sendzimir | 72/243.6 |
| 2,479,974 | 8/1949 | Sendzimir et al. | 72/242.4 |
| 2,776,586 | 1/1957 | Sendzimir | 72/242.4 |
| 3,513,480 | 5/1970 | Robinson | 384/535 |
| 3,549,220 | 12/1970 | Robinson et al. | 384/535 |
| 3,815,401 | 6/1974 | Sendzimir et al. | 72/242.4 |
| 3,848,304 | 11/1974 | Lucas | 492/39 |
| 3,879,828 | 4/1975 | Troost | 72/252.5 |
| 3,958,311 | 5/1976 | Küsters et al. | 29/447 |
| 4,040,158 | 8/1977 | Payne | 492/47 |
| 4,289,013 | 9/1981 | Hunke | 72/242.4 |
| 4,872,247 | 10/1989 | Nakamura et al. | 492/39 |

FOREIGN PATENT DOCUMENTS

| | | | |
|---|---|---|---|
| 2503916 | 8/1976 | Germany | 72/243.6 |
| 0141304 | 11/1980 | Japan | 72/242.2 |
| 0173006 | 10/1983 | Japan | 72/242.4 |
| 0087906 | 5/1984 | Japan | 72/237 |
| 0108401 | 4/1990 | Japan | 72/242.4 |
| 1585034 | 8/1990 | U.S.S.R. | 72/252.5 |
| 162466 | 5/1921 | United Kingdom | 384/581 |
| 2132122 | 7/1984 | United Kingdom | 72/242.4 |

*Primary Examiner*—Lowell A. Larson
*Assistant Examiner*—Thomas C. Schoeffler
*Attorney, Agent, or Firm*—Frost & Jacobs

[57] ABSTRACT

Improved B and C backing bearing assemblies and second intermediate idler rolls, characterized by greatly reduced transverse rigidity, for use in 20-high cluster mills having a 1-2-3-4 roll arrangement. On each of the B and C backing assemblies, spacers are used to provide narrow gaps between the roller bearings and the shaft eccentrics so that they do not form a rigid tube about the shafts of the B and C backing bearing assemblies. Segmented bridge elements are provided to transfer the load from the middle to each side of each roller bearing. Tie means, tying all the parts together axially (including the roller bearings the eccentrics, the bridge means and the spacing means), are provided in a form which is flexible in transverse bending. The idler roll of the second intermediate rolls constitutes a solid, rod-like, transversely flexible core, mounting a series of slightly spaced rings to form the roll body. Each ring is provided with counterbores from each of its ends so that only a short central portion of each ring contacts the core.

21 Claims, 10 Drawing Sheets

CLUSTER MILL CROWN ADJUSTMENT SYSTEM

REFERENCE TO RELATED APPLICATION

The present application is a continuation-in-part of application Ser. No. 07/917,157, filed Jul. 20, 1992, now abandoned, in the names of the same inventors and entitled; IMPROVED PROFILE ADJUSTMENT FOR CLUSTER MILLS.

TECHNICAL FIELD

The invention relates to 20-high cluster mills having a 1-2-3-4 roll arrangement, and more particularly to improvements in the construction of backing assemblies and second intermediate idler rolls having greatly reduced transverse rigidity enabling more complex roll gap profiles to be achieved.

BACKGROUND ART

This invention applies to 20-high cluster mills used for the cold rolling of metal strip, and having a 1-2-3-4 roll arrangement as shown in U.S. Pat. Nos. 2,169,711; 2,187,250; 2,479,974; 2,776,586 and 4,289,013, such mills being commonly known as "Sendzimir" mills, "Z" mills or "Sendzimirs".

It is particularly concerned with improved means for shaping the profile of the rolling mill to the profile of the strip, in order to achieve uniform elongation at every point across the width of the strip, thus enabling uniform tension distribution, and strip of good flatness.

In cluster mills of the type to which the present invention is directed, as shown in FIGS. 1–5, a pair of work rolls 12, between which the strip 8 passes during the rolling process, is supported by a set of four first intermediate rolls 13, which are in turn supported by a set of six second intermediate rolls consisting of four driven rolls 15 and two non-driven idler rolls 14. The second intermediate rolls are supported in their turn by eight backing assemblies, each consisting of plurality of roller bearings 30 mounted upon a shaft 18. The shaft 18 is supported at intervals along its length by saddles, each saddle consisting of a ring 31 and a shoe 29 (these parts being bolted together). The saddle shoes 29 rest in a series of partial bores in a mill housing 10, of the type generally described in U.S Pat. No. 3,815,401.

It is normal practice to label the backing assemblies and their components as shown in FIG. 5, where, in this view of the operator's side or front of the mill, the leftmost upper assembly is labelled "A", and working clockwise around the mill, the remaining assemblies are labelled "B" through "H". This labelling convention will be followed in this specification, such labels being applied to both assemblies and constituent parts.

In general, all of the saddles on all eight backing assemblies include eccentrics 23, which are keyed to the respective shafts, (similar to what is shown at 24 in FIG. 3) and provided with bearing surfaces on their outside diameters, which engage with bores in saddle rings 31, such that rotation of the respective shafts will cause radial motion of shafts and of bearings mounted thereon.

In the case of assemblies A,D,E,F,G and H, the saddles are known as "plain saddles" and eccentrics 23 mount directly within saddle rings 31, and slide within these rings as the respective shafts are rotated. In such cases, because the friction between the sliding surfaces is high, shafts will not be adjusted under load (i.e. during rolling). A,D,E and H shafts eccentrics are known as the "side eccentrics". Rotating these shafts is used to adjust the radial position of their bearings to take up wear on rolls 12 through 15.

F and G shaft eccentrics are known as the "lower screwdown eccentrics". Rotation of F and G shafts and their eccentrics can be used to take up for roll wear also, but is more frequently used to adjust the level of the top surface of lower work roll 12. This is known as "adjusting the pass line height" or "pass line adjustment".

In the case of assemblies B and C, the saddles are known as "roller saddles". For small mills (which have no crown adjustment) the construction is the same as for the plain saddles, with the exception that a single row of rollers (similar to those shown at 37 in FIG. 3) is interposed between the outside of each eccentric 23 and the inside of the mating saddle ring 31. This enables the shafts and eccentrics (which are keyed together similarly to what is shown in FIG. 3) to roll within saddle rings 31. The friction is then sufficiently low for adjustment to be made under load. This adjustment is known as the "upper screwdown" or "screwdown" and is used to adjust the roll gap (gap between work rolls 12) under load. The method adopted, as is well known in the art, is to use two double racks (not shown), one engaging gears 22 on shafts B and C at the operator's side, and one engaging gears 22 on shafts B and C at the drive side (see FIG. 4). Each double rack is actuated by a direct acting hydraulic cylinder, and a position servo is used to control the position of the hydraulic pistons, and so control the roll gap.

For larger mills (and for some newer small mills) provision is made for individual adjustment of the radial position of shaft, bearings and eccentric rings at each saddle position. This adjustment is known as "crown adjustment" and the prior art construction used to achieve it is shown generally in FIGS. 1 through 4.

On the B and C saddles, the saddle rings 31 are provided with a larger diameter bore 32, so that a second set of rollers 33 and a ring 34 (the outside diameter of which is eccentric relative to its inside diameter) can be interposed between saddle ring 31 and rollers 37. Rings 34 are known as "eccentric rings". A gear ring 38, having gear teeth 40, is mounted on each side of each eccentric ring 34, and rivets 39 are used to retain gear rings 38, eccentric 23, eccentric ring 34, saddle ring 31 and shoe 29, with two sets of rollers 33 and 37, together as one assembly, known as the saddle assembly.

As shown in FIGS. 1 and 2, a double rack 41 is used at each saddle location, to engage with both sets of gear teeth 40 on each gear ring 38 on both B and C saddle assemblies. A hydraulic cylinder, or motor driven jack (not shown), is used at each saddle location in order to translate the rack. In the example of FIG. 4, seven individual drives would be provided, one at each saddle location. These are known as "crown adjustment" drives. If one drive is operated, its respective double rack 41 moves in a vertical direction, rotating the associated gear rings 38 and eccentric rings 34. This causes radial movement of eccentrics 23 on shafts B and C at the saddle location on which the eccentric rings rotate, and a corresponding change in the roll gap at that location, shafts 18 bending to permit this local adjustment.

Although independent drives are provided at each saddle location, the adjustment is not truly independent, due to the transverse rigidity (i.e. resistance to bending) of each shaft 18. This rigidity is augmented by the practice of clamping all the eccentrics 23 and inner rings of bearings 30 axially along the length of the shaft between screwdown gears 22, thus effectively forming a tube along the outside of each shaft 18, which stiffens the shaft and makes bending of the shaft even more difficult. This stiffness is sufficiently high to cause stalling of any drive which is driven to a position too far away from the position of the neighboring drives.

Furthermore, any profile of the backing assembly achieved by operation of the crown adjustment drives is not fully effective at the roll gap, because of the transverse rigidity of intermediate rolls between assemblies B and C and the work roll. Since work rolls 12 and first intermediate rolls 13 are relatively small in diameter, they are flexible and so create no problems. The drive rolls 15 primarily transfer forces between first intermediate rolls 13 and backing assemblies A and D (or E and H), and are only obliquely supported by backing assemblies B and C (or F and G). The primary path of the support forces provided by backing assemblies B and C is through the upper idler roll 14, and it is the rigidity of this roll which can attenuate the effect of profile adjustments on B and C assemblies, particularly if profiles having double or triple curvature, rather than simple crowned (i.e. single curvature) forms, are attempted.

In fact, the prior art teaches us that the means shown in FIGS. 1 through 4 is a means of crown adjustment, although it is well known in the art that the means can be used to "tilt" the mill, i.e. to provide a roll gap which is tapered in form, being larger at one end of the work rolls than the other end. It should be noted that such "tilting" does not require bending of backing shafts 18.

It is the object of this invention to provide means to enable more complex roll gap profiles to be achieved on such mills, by providing new forms of backing shafts and idler rolls, which have much smaller transverse rigidity than prior art forms, and to provide new mountings for bearings and eccentrics on backing shafts which will not cause augmentation of transverse rigidity.

DISCLOSURE OF THE INVENTION

According to the invention there are provided B and C backing bearing assemblies of reduced transverse rigidity for a 20-high cluster mill.

In all of the embodiments, the B and C backing bearing assemblies each comprise a shaft, a plurality of eccentrics spaced along the shaft and keyed in phase thereto, and a plurality of roller bearings (each comprising an inner ring, a plurality of rollers, and an outer ring) mounted on the shaft between the eccentrics. The shaft is supported by saddles, each comprising a shoe and a ring affixed thereto. Each saddle ring has an opening adapted to receive one of the shaft eccentrics, an eccentric ring, and rollers between the shaft eccentric and the eccentric ring and additional rollers between the eccentric ring and the saddle ring. Gear rings are attached to either side of the eccentric ring for crown adjustment. The shaft also has screwdown gears keyed thereto adjacent the outermost eccentrics.

The reduced transverse rigidity of the B and C backing bearing assemblies is accomplished by providing means to space the roller bearings and saddles from each other so that they do not form a rigid tube about the shafts of the B and C backing bearing assemblies. Segmented bridge means, to transfer the load from the middle to each side of each roller bearing, are provided. Further, the tie means tying all the pans together axially (including the roller bearings, the eccentrics, the bridge means and the spacing means) is provided in a form which is flexible in transverse bending.

In one embodiment, "O"-rings are mounted between each side of each bearing inner ring and the adjacent eccentric to form a gap therebetween. Each bearing inner ring is of increased wall thickness and has a central annular recess in its inner surface forming extended supporting edge portions. Each eccentric is mounted on and keyed to a mounting ring which extends to either side thereof and supports an extended edge portion of each adjacent bearing inner ring. Each mounting ring is keyed to the shaft with the eccentrics in phase. The shaft is reduced in diameter by more than half and is provided with longitudinal external grooves connecting with radial holes in the bearing inner rings for directing lubricant to the bearing rollers.

A second embodiment is similar to the first with the exception that each mounting ring and its respective eccentric comprise an integral one-piece structure.

A third embodiment is similar to the first and second embodiments with the exception that the mounting rings of the eccentrics are eliminated and the shaft is increased in diameter such that the bearing inner ring extended supporting edge portions bear directly on the shaft as do the eccentrics which are keyed thereto in phase. The shaft diameter in this embodiment has been reduced by about 30%.

In a fourth embodiment, the eccentrics and the bearings are essentially conventional with the exception that "O"-rings serve as spacers therebetween. The shaft is of substantially conventional diameter, but comprises an assembly of separate end sections under each end bearing and separate intermediate sections under each intermediate bearing. The shaft sections are mounted on a tube and are separated thereon by "O"-rings. The sections are additionally joined together by dowels for alignment and torque transmission. The shaft also serves as a lubrication conduit connected by radial holes in the tube, the shaft sections and the bearing inner rings to the bearing rollers. The shaft sections are provided with keyways to which the screwdown gears and the eccentrics are keyed in correct orientation to each other and the shaft sections.

A fifth embodiment is similar to the fourth embodiment with the exception that the shaft assembly is divided into sections tied together by two large longitudinally extending diametrically opposed keys. Springs are mounted in the shaft section ends to provide narrow gaps therebetween. A central lubrication passage is provided in the shaft sections with hollow sleeves and "O"-rings sealing the gaps between the segments. Radial oil holes in the shaft segments and the bearing inner rings lead to the bearing rollers. Springs in pockets in all but the endmost eccentrics assure gaps between these eccentrics and the adjacent bearing inner rings. The screwdown gears and the eccentrics are keyed to the shaft assembly in a keyway formed therein.

A final embodiment is provided with a shaft having dimensions similar to the prior art shaft of FIG. 4. The shaft is provided with pairs of transversely extending T-shaped slots as will be described hereinafter. The T-shaped slots define the boundaries of different zones within the shaft and render the shaft more flexible. The eccentrics and bearings are substantially identical to those of the embodiment of FIG. 10. The shaft is provided with a pair of smaller longitudinally extending lubrication bores, rather than a single larger bore so as not to conflict with the pairs of T-shaped slots. The lubrication bores extend from one end of the shaft toward, but not through the other. Radial oil holes deliver oil from these two bores to circumferential grooves in the outer surface of the shaft, from which the oil can flow into the bearings by means of radial holes in the bearing inner rings.

The invention also contemplates the provision of the idler roll of the second intermediate rolls in the form of a composite roll comprising a solid, rod-like, transversely flexible core, mounting a series of slightly spaced rings to form the roll body. Each ring is provided with counterbores from one or both ends so that only a short portion of each ring contacts the core, assuring transverse flexibility of the structure.

DETAILED DESCRIPTION OF THE INVENTION

Figure 1:
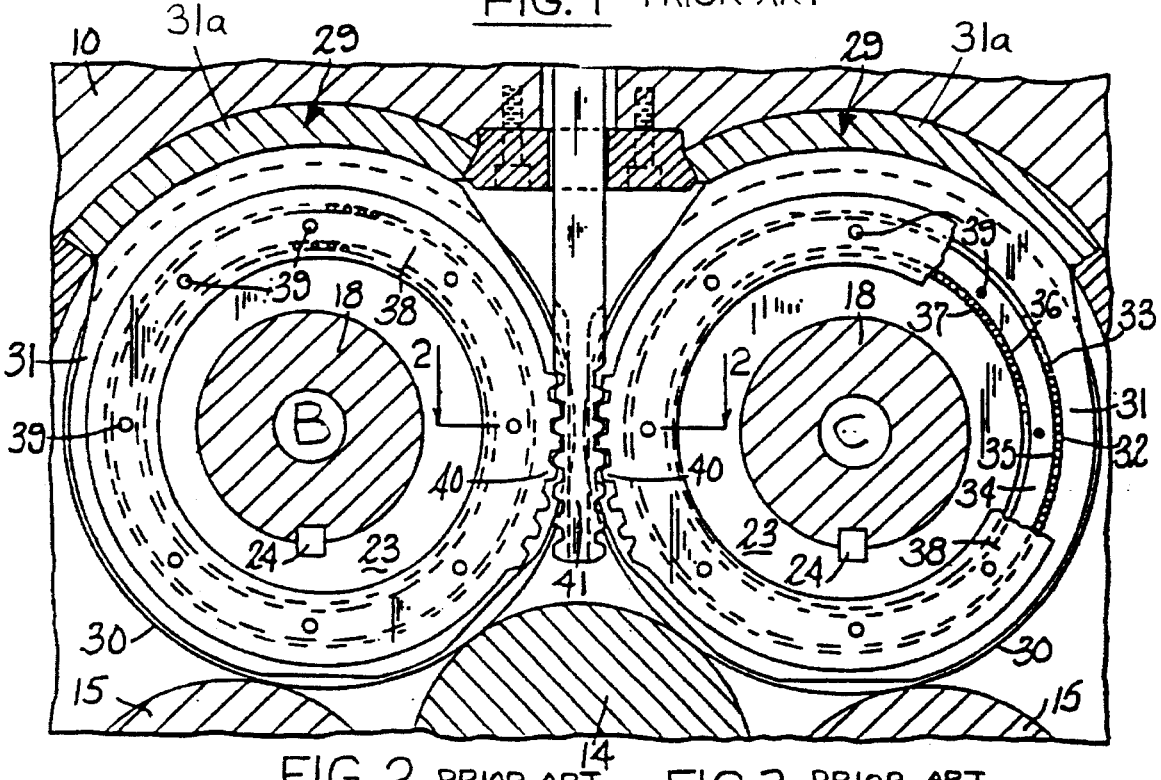
FIG. 1 PRIOR ART
FIG. 1 is a fragmentary elevational view, partly in cross section, of prior art backing assemblies B and C of a 20-high cluster mill.
Figure 2:
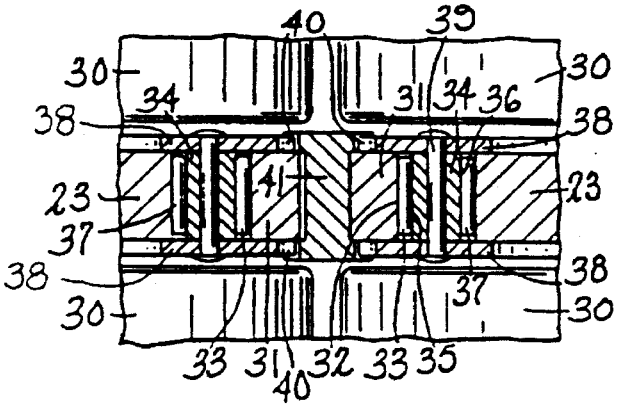
FIG. 2 PRIOR ART
FIG. 2 is a fragmentary cross sectional view taken along section line 2—2 of FIG. 1 showing engagement of one crown adjusting rack and its respective gears.
Figure 3:
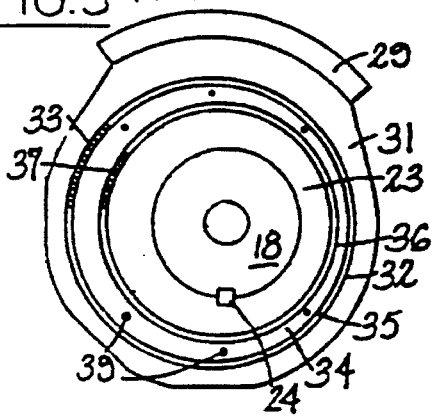
FIG. 3 PRIOR ART
FIG. 3 is a cross sectional view of a typical B and C saddle assembly according to the prior art.
Figure 4:
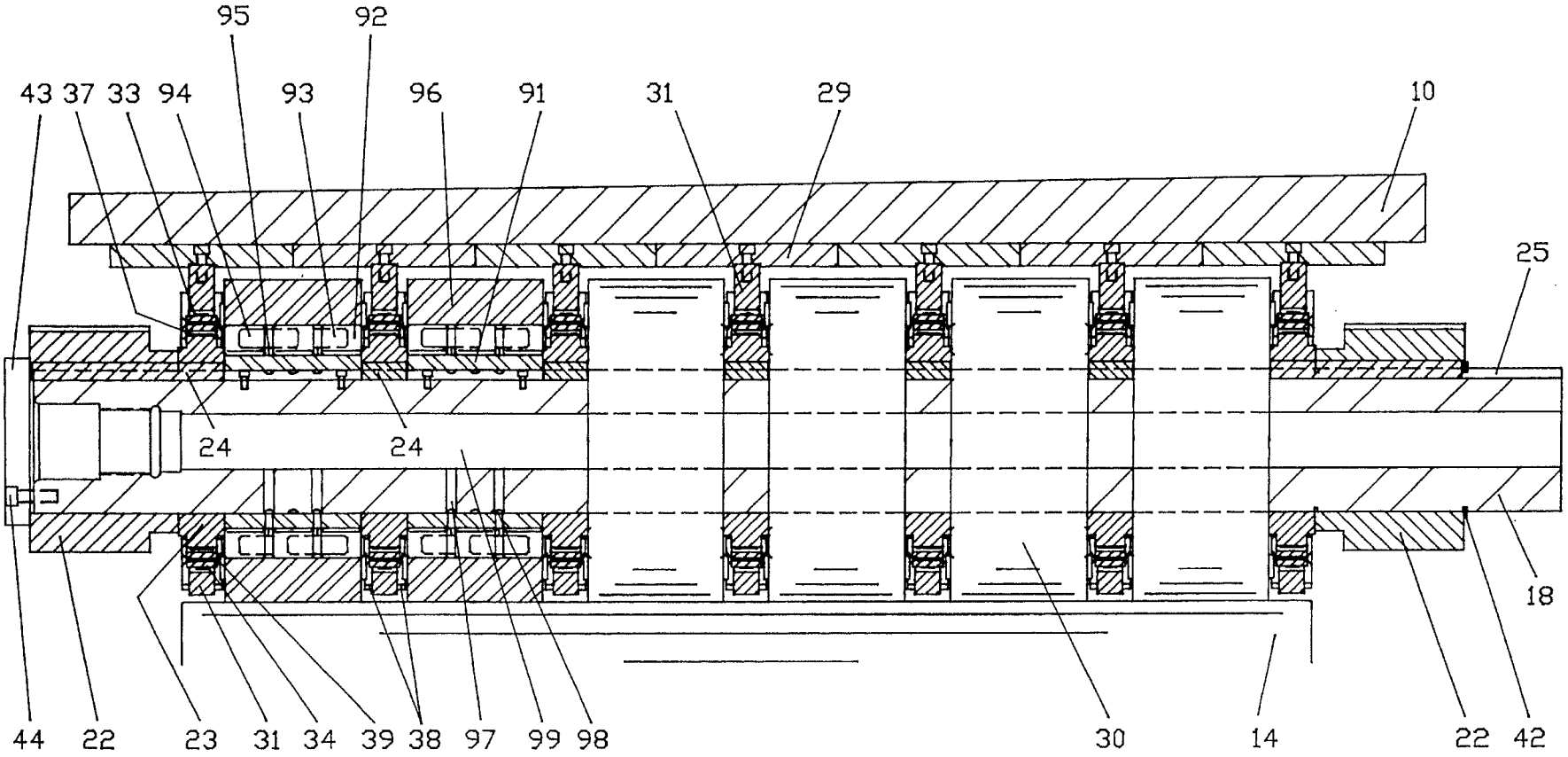
FIG-4 (PRIOR ART)
FIG. 4 is a longitudinal cross sectional view of a typical prior art B or C backing assembly having six bearings and seven saddles.

In FIG. 4 a prior art B backing assembly is shown. It will be understood that backing assembly C will be substantially the same. Distributed force U (see FIG. 5), which develops as a result of the roll separating force P which acts between work rolls 12 due to deformation of the work piece between these rolls, must be transferred from the rotating idler roll 14 to mill housing 10 via the backing assemblies B and C, each comprising bearings 30, a shaft 18 and saddle assemblies, each comprising an eccentric 23, an eccentric ring 34, a saddle ring 31, a saddle shoe 29, rollers 33 and 37, gears 38 and rivets 39 (see also FIGS. 1 and 2).

Bearings 30 may be of various types, but all types include rollers 92, an inner ring 91 and an outer ring 96. Cages 93, 94 and spacer rings 95 may be included. On all types the outer ring 96 has a heavy cross section since it is only loaded at one or two points on its circumference (see FIG. 1 or FIG. 5) and the heavy cross section gives better load sharing between the rollers 92 in each row. The bearings may have one, two, three or even tour rows of rollers 92. The example shown, having 3 rows, is the most common type. The inner ring 91 is always made of light cross section i.e. small radial thickness. This enables rollers 92 to be as large as possible thus maximizing load capacity of the bearing. Since inner ring 91 is fully supported throughout its length by shaft 18, it is not necessary for it to have a heavy cross section.

In principle, to achieve the required load transfer from idler roll to mill housing, while enabling the normal screwdown to be achieved by rotation of eccentric gears 22 and eccentrics 23 together, the following functions are supplied by this construction.

Function 1: spacing of bearings and eccentrics—this is achieved by clamping the screwdown gears 22, bearings 30 and eccentrics 23 on shaft 18, and against snap ring 42, using clamp ring 43 which is clamped tight by screws 44 which screw into the shaft 18.

Function 2: a bridge device to transfer force on all rows of rollers 92 in each bearing 30 to each side of said bearing. This purpose is served by shaft 18.

Function 3: a boss device to transmit bearing force to eccentric 23 at each side of each bearing 30. This purpose is served by shaft 18.

Function 4: an alignment device to set all eccentrics 23 and both screwdown gears 22 in line and in phase. This device must have sufficient torsional rigidity and strength to transmit the torque from screwdown gears 22 to all the eccentrics 23 with negligible twist. This purpose is served by shaft 18 with keys 24 fitting in a full length keyway 25 therein, said keys each engaging an eccentric 23 or screwdown gear 22.

Function 5: a beam device to support the overhung load of the screwdown racks acting upon screwdown gears 22. The purpose is served by shaft 18.

Function 6: a tie device to tie all the parts together axially. This purpose is served by shaft 18.

It can thus be readily understood that the shaft 18 fulfills several functions.

In order to achieve effective profile control of the assembly, it is necessary for shaft 18 to be very flexible. However, this shaft must transmit torques of a high order of magnitude, in order to support the action of forces U and V, acting eccentrically upon the center of rotation of the gears and eccentrics. Therefore the shaft is usually made from forged alloy steel with a diameter close to from about 44% to about 46% of the outside diameter of bearings 30 and so is very stiff. Furthermore, the shaft stiffness is augmented by the series of rings consisting of the eccentrics 23 and bearing inner rings 91 which are clamped tightly together on the shaft, as described above.

Because this structure has such a high transverse rigidity it is generally only possible to achieve a simple curved profile, or a simple tilt profile using rotation of the eccentric rings. Attempts to form more complex profiles including curvature reversal (points of indexion) will generally be frustrated by stalling of the adjustment drives caused by resistance of the structure to bending.

Since some of the most troublesome flatness defects which occur on strip rolled on such mills require more complex mill profiles to correct them, there is a strong need to provide more flexibility in the backing assembly structure to enable more complex profiles to be achieved.

To achieve the necessary flexibility of support for the bearings, the functions should be modified as follows:

With respect to Function 1, the means used for spacing bearings and eccentrics must be flexible in transverse bending.

With respect to Function 2, the bridge device which transfers force on all rows of rollers 92 in each bearing 30 to each side must be segmented i.e. a separate bridge device must be used at each bearing.

With respect to Function 6, the tie device must be flexible in transverse bending.

Figure 6:
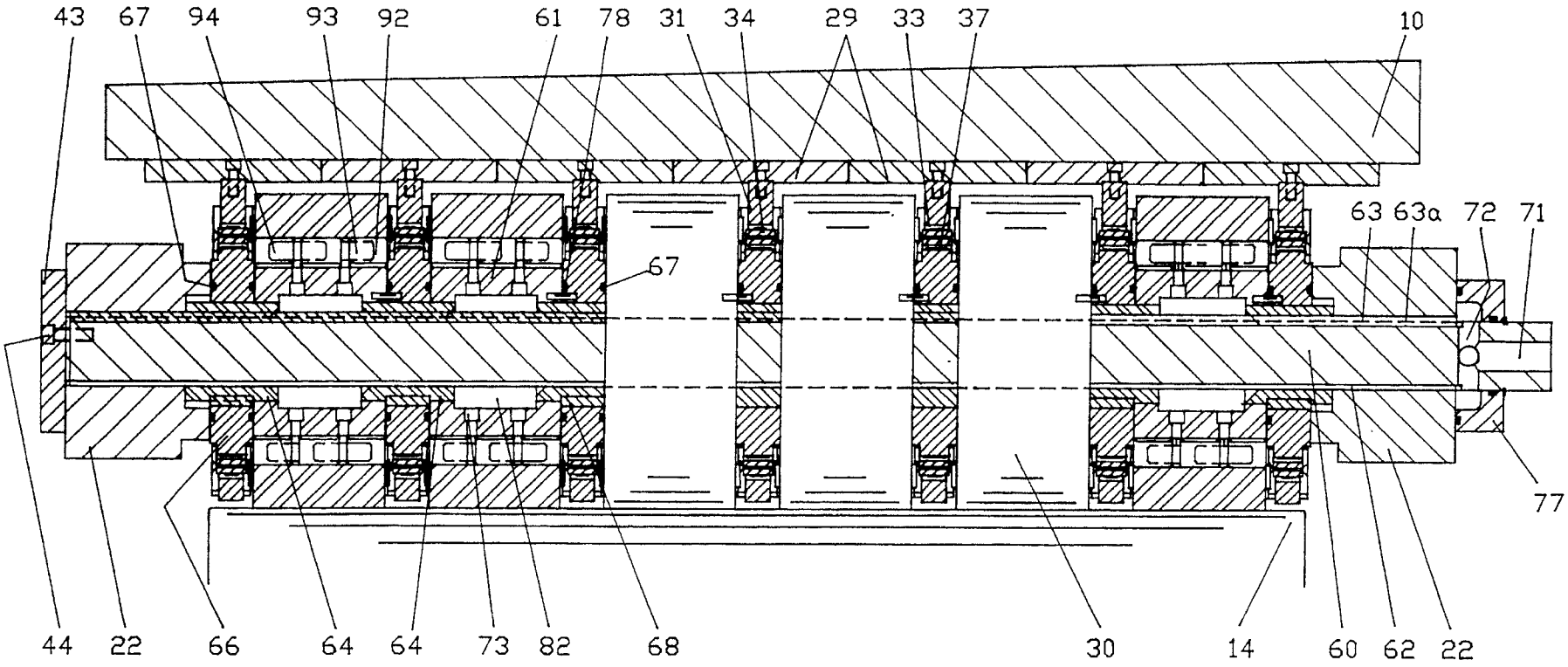
FIG. 6 is a longitudinal, cross sectional view of a backing assembly according to one embodiment of the present invention.

One embodiment of the present invention is shown in FIG. 6. In this embodiment the function of spacing of bearings and eccentrics (Function 1) is achieved in a similar fashion to the prior art (FIG. 4), except that "O"-rings 67 are mounted between each side of each bearing inner ring 61 and each eccentric 66, so that alter clamp screws 44 are tightened, a gap remains on either side of each bearing 30, between said inner ring 61 and the adjacent eccentrics 66. Because the "O"-rings are resilient, shaft 60 is free to bend without restriction. It is also possible to use wave washers or disc springs instead of "O"-rings 67 to perform the same function.

The bridge function (Function 2) is achieved by making a new inner ring 61 for the bearings, replacing the prior art inner ring 91 of FIG. 4. This inner ring 61 is made with a much heavier wall so that it is only necessary to support it at its ends. This support (Function 3) is provided by rings 64, which transfer the bearing forces to eccentrics 66. These eccentrics are similar to the prior art eccentrics 23 of FIG. 4, but have a smaller bore corresponding to the inside diameter of inner rings 61, since both inner rings 61 and eccentrics 66 fit on the outside diameter of rings 64.

Shaft 60 provides the alignment function (Function 4) by being keyed to screwdown gears 22 and rings 64 by a single key 63 which runs the full length of shaft 60, in keyway 63*a*. Rings 64 are keyed to their respective eccentrics 66 by keys 68.

Shaft 60 also provides the beam function (Function 5) by supporting the overhung load on each screwdown gear 22.

Figure 7:
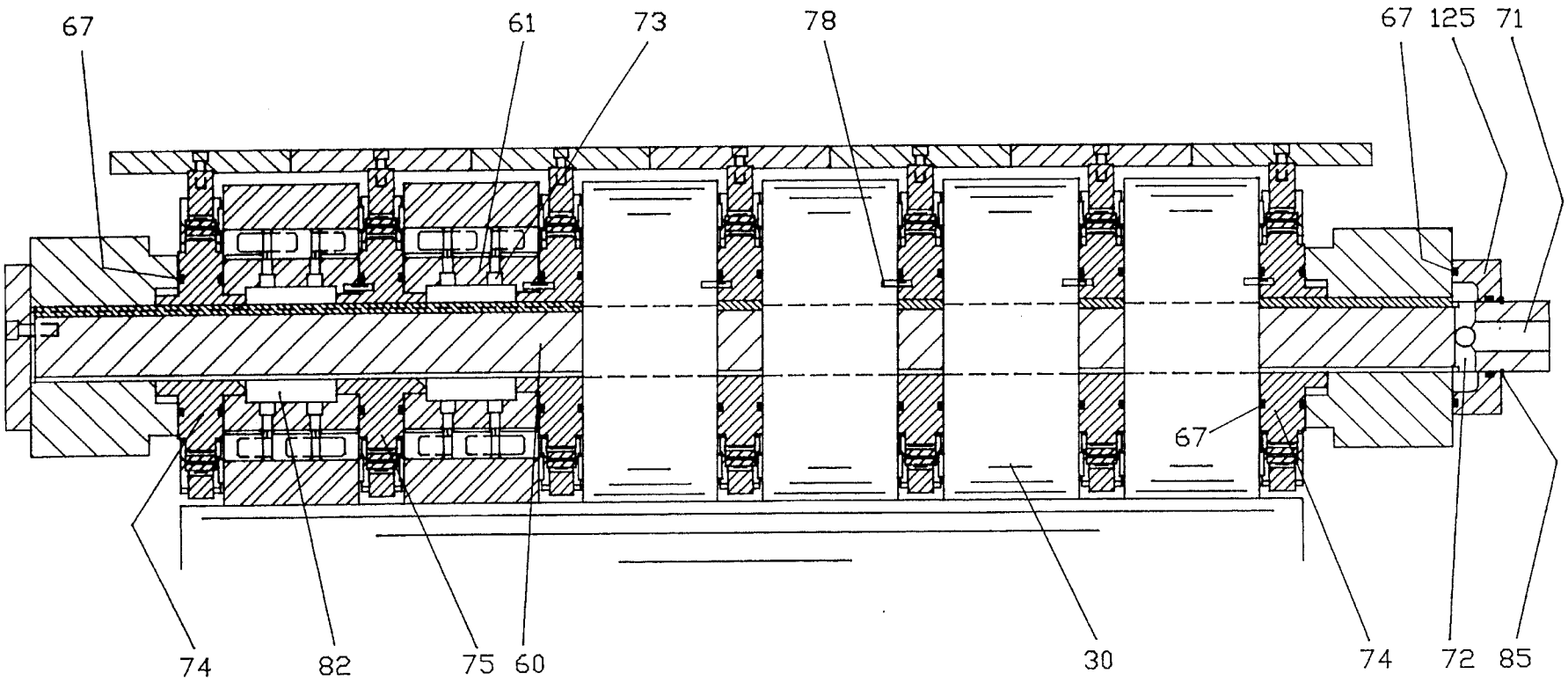
FIG. 7 is a longitudinal, cross sectional view of a second embodiment of a backing assembly of the present invention.

Lubricating oil is supplied to bearings 30 through hole 71 in one end of shaft 60. This connects with radical holes 72 in said shaft, and the oil flows through these holes to the inside of header 77 from which it flows through additional grooves 62 in shaft 60 (similar to keyway 63*a*), and then through radial holes 73 in bearing inner ring 61 to the bearing rollers 92. The embodiment of FIG. 7 is similar to that of FIG. 6, with the exception that the rings 64 and eccentrics 66 of FIG. 6 are made in one piece to form new end and intermediate eccentrics 74 and 75, thus eliminating the keys 68 of FIG. 6. These new eccentrics combine Function 3 with their normal eccentric function, so the bearing load can be transferred directly from bearing inner ring 61, to eccentrics 74 and 75. In the embodiments of FIG. 6 and FIG. 7, pins 78 are used to prevent rotation of bearing inner rings 61, as axial clamping forces are not sufficient to prevent such rotation.

In the embodiments of FIGS. 6 and 7 the shaft 60 is very slender. It is less than half the diameter of the prior art shaft 18 of FIG. 4. It would be likely to twist excessively on a mill subjected to high loads. In such a case the embodiment of FIG. 8 would be adopted. In this embodiment bearing inner rings 61 are the same as those used in the embodiments of FIG. 6 or 7, and fulfill Function 2 (that is, bridging from the middle to the side of the bearing). Also, eccentrics 66 and keys 68 are the same as those of FIG. 6. The boss function (Function 3) is now provided by shaft 80 which is sized to fit the bores of eccentrics 66 and bearing inner rings 61 which are of the same diameter. Recesses 82 in the bores of inner rings 61 ensure that shaft 80 is not constrained against flexure by the bearing inner rings, and that the inner rings 61 can provide their bridging function in transferring the bearing load to the sides of the bearing, where shaft 80 transfers the load in shear from inner rings 61 to eccentrics 66 (and thus provides the boss function).

As in the other embodiment, "O"-rings form flexible spacers between inner rings 61 and eccentrics 66, ensuring a small gap between the respective parts, enabling the structure to flex freely after clamp screws 44 are tightened, to secure all the parts 43, 22, 66, 61 and 84 on the shaft, against snap ring 85.

Pins 78 are used to prevent rotation of inner rings 61, since axial clamping forces are not sufficient to ensure this. Shaft 80 also provides the alignment function (Function 4), by virtue of keyway 86 which extends almost the full length of the shaft and keys 68 and 83 which locate eccentrics 66 and screwdown gears 22 respectively on the shaft 80. The shaft 80 also provides the beam function (Function 5) to support the overhung loads acting on screwdown gears 22. As in embodiments of FIGS. 6 and 7, the shaft 80 is provided with additional slots 87 similar in size to keyway 86, these slots 87 being utilized to provide a flow path for the lubricating oil from the hole 71 at one end of the shaft to the radial holes 73 in bearing inner rings 61.

The embodiments of FIGS. 6 and 7 achieve a reduction of just over 50% in the diameter of the backing shaft, and thus increase the flexibility by a factor of $2^4$ or 16. Shaft 60 of FIGS. 6 and 7 is less than half the diameter of shaft 18 of FIG. 4, but at least for highly loaded mills shaft 60 might twist excessively under load. The embodiment of FIG. 8 provides a shaft diameter of 70% of that of shaft 18 of FIG. 4, and so increases flexibility by a factor of $(1/.7)^4$ or 4, while giving less twist than the shafts 60 of FIGS. 6 and 7.

Figure 8:
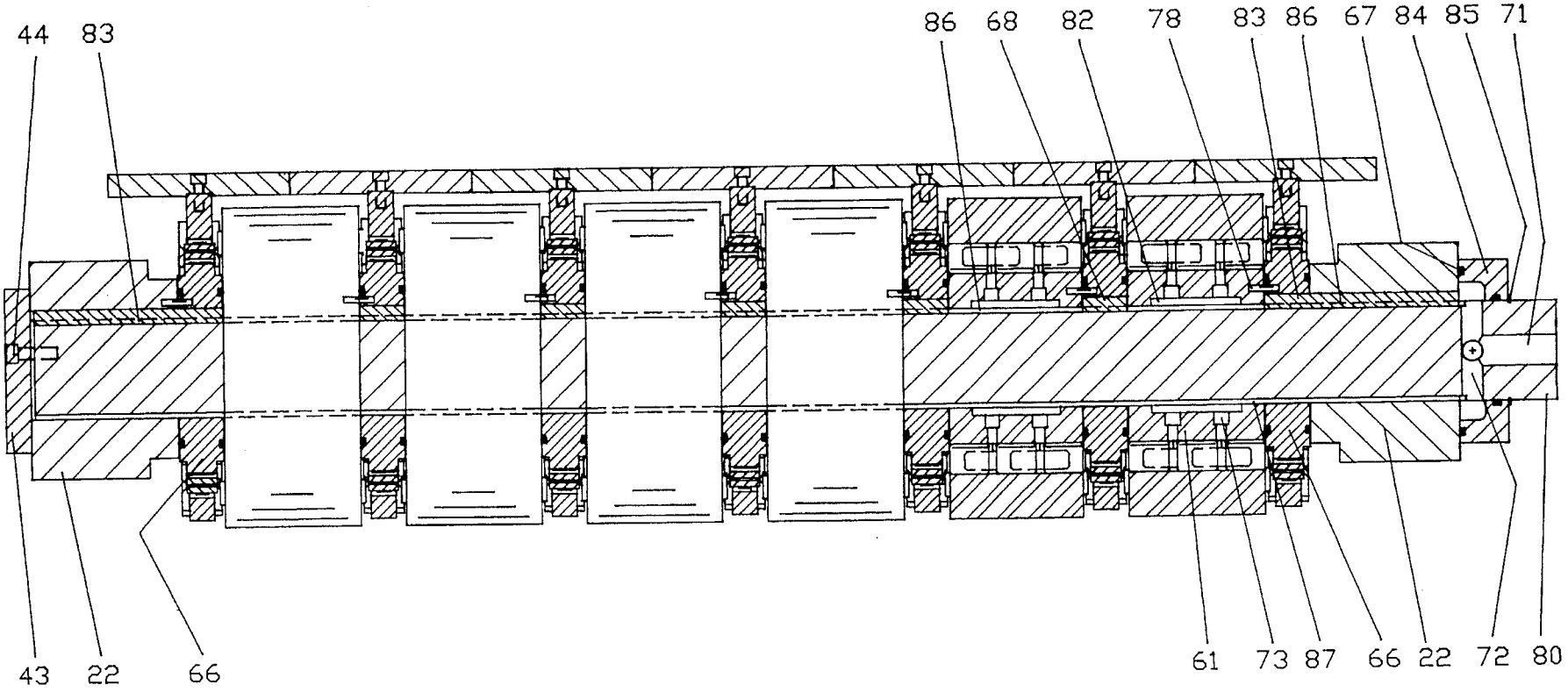
FIG. 8 is a longitudinal, cross sectional view of another embodiment of the backing assembly according to the invention.

In the embodiments of FIG. 6, 7 and 8, the radial oil holes 97 and grooves 98 of the prior art shaft 18 of FIG. 4 are eliminated in order to avoid the stress concentrations caused by these items. Central hole 99 of FIG. 4 is also not required. The oil feed to the bearings, as described above, is supplied through key slots in the outside of the shaft. Since a single keyway is required anyway, the additional slots for oil flow give no increase in maximum stress in the shaft.

Figure 9:
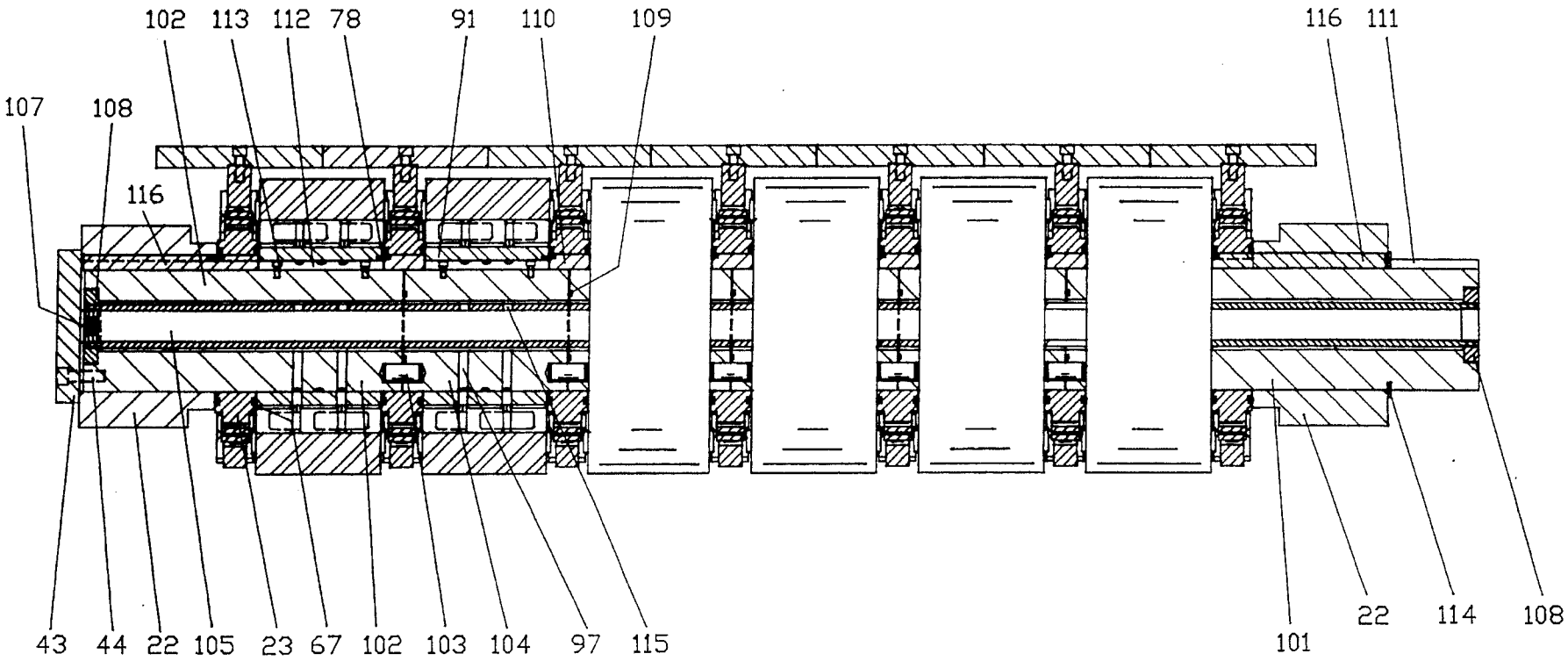
FIG. 9 is a longitudinal, cross sectional view of another embodiment of the backing assembly of the present invention.

In the embodiment of FIG. 9, the bearing inner rings are thin-walled as in the prior an structure of FIG. 4. The bridging function (Function 2) is provided by short sections of shaft, which is split axially into sections 101 and 102 under each end bearing, and into sections 104 under each intermediate bearing. These sections are pinned together using dowels 103 in order to transmit the torque from shaft section to shaft section and thus from screwdown gears 22 to the eccentrics 23, which are the same as the prior art screwdown gears 22 and eccentrics 23 of FIG. 4.

The shaft sections 101,102 and 104 are tied together by means of tube 105, which is provided with threads on each end, onto which nuts 108 are screwed. The shaft sections are separated by "O"-rings 109, which provide a flexible joint between them, with a small gap remaining between adjacent shaft ends when nuts 108 are fully tightened. Tube 105 is plugged at one end with plug 107, and oil is delivered to the bearings from the other end of tube 105 through said tube and through radial holes 115 in tube 105 and radial holes 97 in shaft sections 101, 102 and 104.

Shaft sections 101,102 and 104 are each provided with keyways 111, and keys 110 and 116 are used to locate eccentrics 23 and gears 22 respectively at the correct orientation to each other and the shafts, and also serve to locate the adjacent shafts in line. As bearing inner rings 91 are thin walled, the prior art practice of using fillers 112 in the portion of each keyway 111 which lies under an inner ring is adopted. Fillers are secured to the respective shaft sections by screws 113.

As in the other embodiments, "O"-rings 67 form flexible spacers between bearing inner rings 91 and eccentrics 23, ensuring a small gap between the respective parts, enabling the structure to flex freely after clamp screws 44 are tightened to secure all the parts 43, 22, 23, 91 on the shaft, against snap ring 114. Pins 78 are used to prevent rotation of inner rings 91, by locking them to keys 110.

Figure 10:
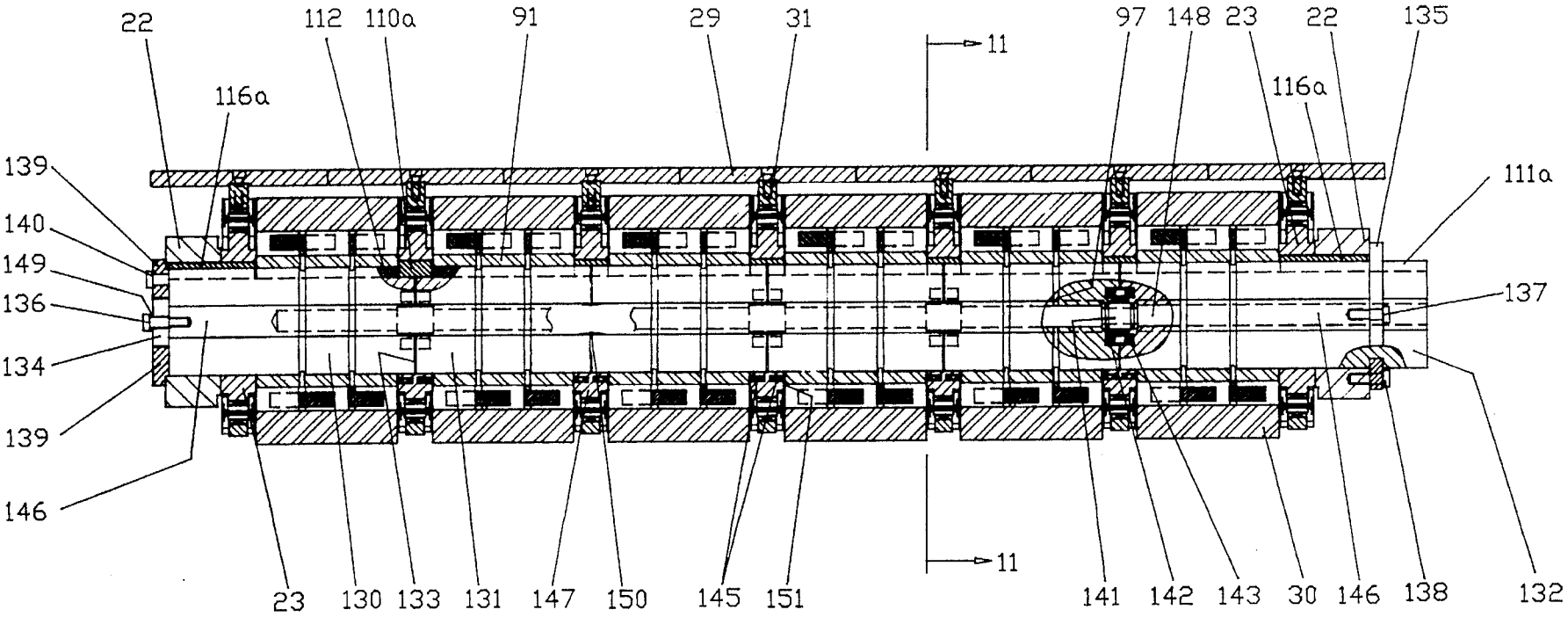
FIG. 10 is a longitudinal, cross sectional view of yet another embodiment of the backing assembly of the present invention.
Figure 11:
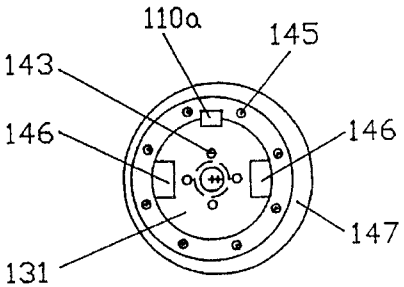
FIG. 11 is a cross sectional view taken along section line 11—11 of FIG. 10.

In FIGS. 10 and 11 we show another embodiment of the invention. In this embodiment the shaft is divided into sections similarly to the embodiment of FIG. 9. These sections comprise end shaft sections 130 and 132, with four inner shaft sections 131 mounted coaxially therebetween. These shaft sections are tied together with two large keys 146, which extend substantially the full length of the shaft assembly. Split ring 135 fits in a groove in shaft section 132 and is bolted to keys 146 using bolts 137 (one of which is shown in FIG. 10). At the other end of keys 146, retainer 134 is bolted to the end of shaft section 130 and to the end of key 146 using shoulder screws, one of which is shown at 136 in FIG. 10. Disc springs 149 are mounted under the head of shoulder screws 136, to take up relative movement between shaft sections and keys 146 as the keys bend under load. This ties the shaft sections together. Springs 143 mounted in pockets in the adjacent shaft section ends are used to ensure that gaps between adjacent shaft section ends are substantially equal. These gaps would normally be set to about 0.5 mm. Keys 146 are provided with short reliefs 150 in the areas of the joints between adjacent shaft sections. This is to allow the keys 146 to bend when the crown adjustment causes adjacent shaft sections to move out of line with each other.

A central oil lubrication hole 148 is provided through the shaft sections, and hollow sleeves 141, fitted with "O"-rings 142 are used to seal the gaps between adjacent shaft sections, but to allow oil to flow between shaft sections. Radial oil holes 97 deliver oil from the central hole 148 out to bearings 30.

The saddle assemblies and bearings are assembled in the order shown on the shaft section assembly, starting with right screwdown gear 22 being anchored to end shaft section 132 by means of bolts 138 which attach it to split ring 135, located in the groove in end shaft section 132.

Retainer plates 139, attached to shaft section 130 at the left side using bolts 40, clamp left screwdown gear 22 and all the shafts and bearings together. The clamping force is determined by springs 145, which are fitted in suitable pockets in central eccentrics 147. These eccentrics are different from the end eccentrics 23 in that they are about 0.5 mm narrower, and include the above noted pockets. When bolts 140 are fully tightened, a gap of about 0.25 mm will be present at each side of each eccentric 147, this being ensured by springs 145.

A third smaller keyway 111*a* is provided which extends along the full length of all the shaft sections. This corresponds to the prior art keyway 25 of FIG. 4, and screwdown gears 22 and eccentrics 23 are keyed to the shaft assembly using keys 116*a* and 110*a* mounted in keyway 111*a*. Fillers 112 are used to fill keyway 111*a* in the areas where it passes through the bearing inner rings 91, as in the prior art. Pin means are provided to prevent rotation of the bearing inner rings 91. These pins have been eliminated in FIG. 10 for purposes of clarity, but they may be of the type illustrated and described with respect to FIG. 8 or FIG. 9.

In this embodiment Function 1 (spacing of eccentrics and bearings), is achieved by springs 145 which substantially equalize the gaps between each side of each bearing and the adjacent eccentric due to the compressional force induced in them by tightening screws 140 holding eccentrics 147 and bearing 130 in position on the shaft assembly.

The bridge device (Function 2) and boss device (Function 3) are provided by the shaft sections 130, 131 and 132, and keys 116*a* and 110*a*.

The alignment device (Function 4) is also provided by keys 146, in combination with shaft sections 130, 131 and 132.

The beam device (Function 5) is provided by shaft section 130 at the left end and shaft section 132 at the right end.

The tie device (Function 6) is provided by keys 146.

It can be clearly seen that this embodiment achieves the requirements of flexible spacing means (Function 1), flexible tie device (Function 6) and separate bridge device (Function 2).

The common features of the embodiments of FIGS. 6 through 11 are: separate bridging means at each bearing, to transfer the load from the middle to the sides of the bearings, such means being able to tilt to follow independent radial movements of the adjacent eccentrics caused by rotation of individual eccentric rings 34; and flexible clamping means which prevent the bearing inner rings and eccentrics from forming a stiff tube when they are clamped together.

Figure 5:
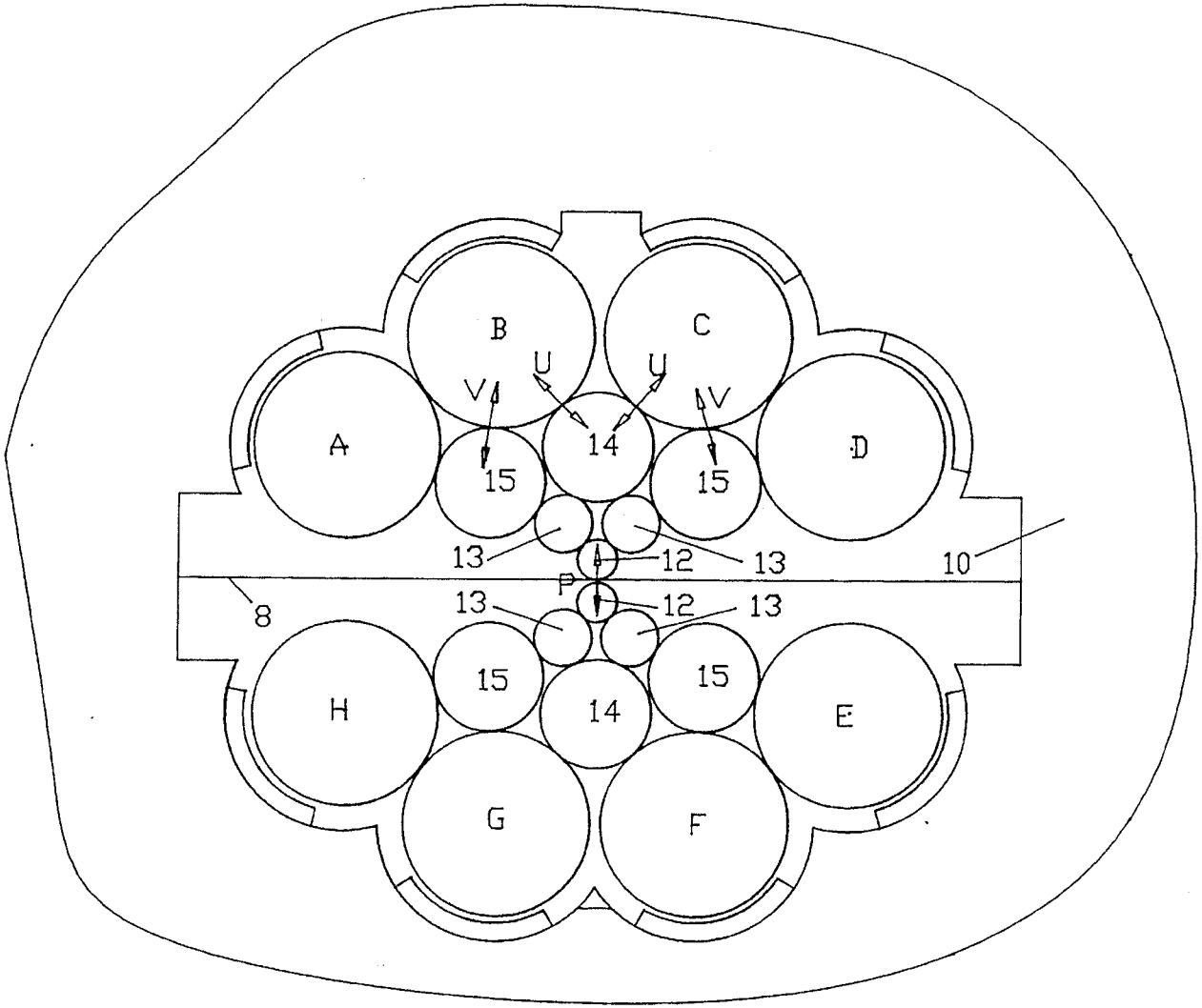
FIG-5 (PRIOR ART)
FIG. 5 is a fragmentary, diagramatic, elevational view showing a typical prior art 20-high roll cluster mill, viewed from the operator's side, and showing naming terminology for the backing assemblies.

When FIG. 5, which shows a 20-high roll cluster of the 1-2-3-4 variety, is examined, and the effect of changing the profile of B and C backing assemblies is considered, it can be seen that such profile changes can only be transferred to the workpiece which is rolled between work rolls 12, if rolls 14, 13 and 12 flex to follow the profiles of the B and C backing assemblies.

First intermediate rolls 13 and work rolls 12 are very slender and will readily flex under the action of the rolling forces. However, second intermediate idler roll 14 is larger in diameter and so is relatively rigid.

Figure 12:
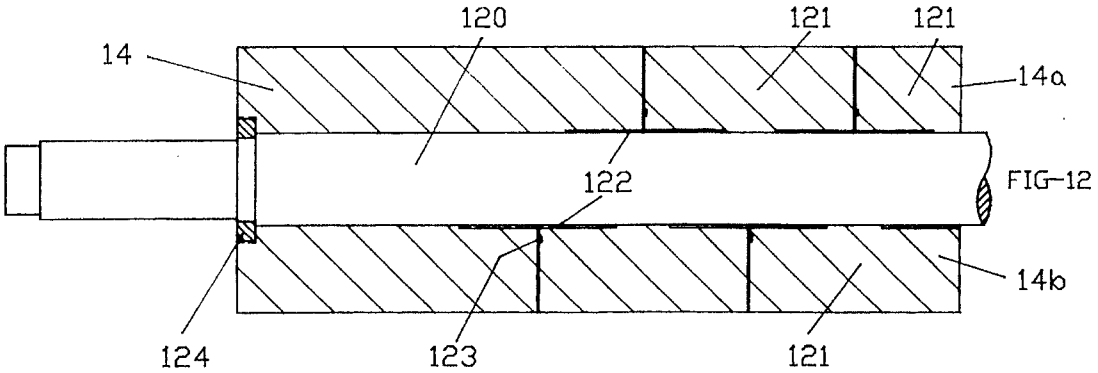
FIG. 12 is a fragmentary, longitudinal, cross sectional view of a second intermediate idler roll of the present invention.

In FIG. 12 we show how the invention, in another aspect, can be used to provide increased flexibility for idler roll 14. The prior art solid forged roll is replaced by a composite roll consisting of a solid core 120 which runs through the whole length of the roll body and extends at both ends to form the roll necks, and on which a series of rings 121 are shrunk to form the roll body. These rings are provided with counterbores 122, so that only a short portion of each ring fits onto core 120. In this way, core 120 is free to flex over most of its length. The same may be accomplished by reliefs formed in the core (not shown) rather than counter bores 122. Since core 120 does not have to transmit any torque, it can be made very small, and hence very flexible. In fact the smaller the shaft, the stronger will the shrink rings (which have to transmit the radial forces from B and C backing bearings to the upper first intermediate rolls 13).

The shrink rings 121 are spaced apart by a small amount (approximately 0.01 in.) so that they do not restrict normal flexure of core 120. This spacing can be achieved by the use of spacer shims which are inserted between successive rings as they are shrunk on, and then removed, or by the use of wave washers or disc springs 123 between successive rings. It is not a good idea to use "O"-rings in this instance due to the adverse effect of the high temperature of the shrink rings (which are heated before assembly as is well known in the art in order to install them and to achieve the normal interference or "shrink" fit obtained by this method).

It is also possible to install rings 121 with a slip fit on core 120. In this case disc springs 123 are essential, and clamp nuts 124 (preferably of the self-locking variety) are then tightened until the desired gap is obtained between successive rings.

Figure 13:
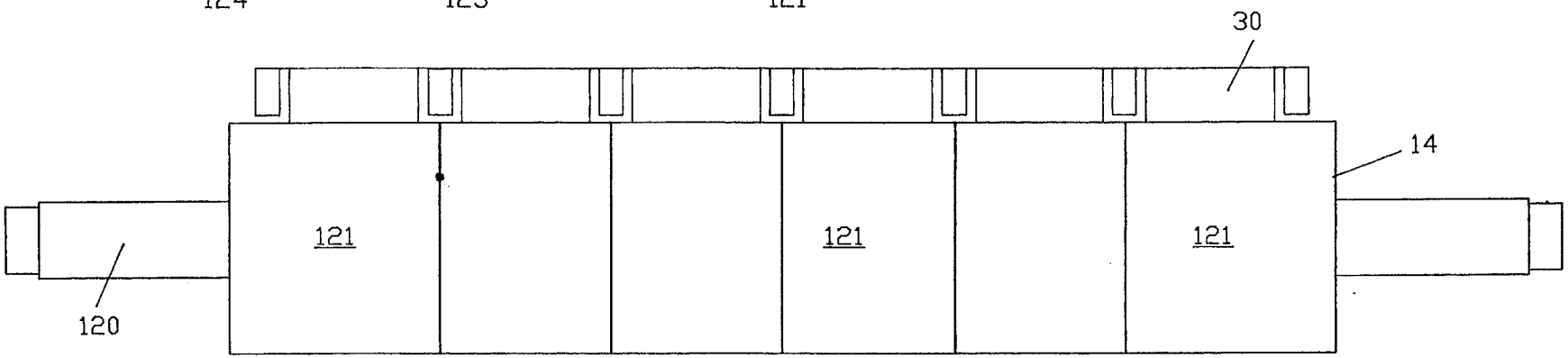
FIG. 13 is a fragmentary, elevational view of a backing assembly and a first embodiment of second intermediate idler roll according to this invention.

In one embodiment the rings are located to provide gaps in-line with saddles of the B and C assemblies, as shown in the upper half of FIG. 12 and in FIG. 13. This arrangement has the advantage that the gap areas of the roll 14 do not contact the B and C bearings, and therefore cannot mark them. Furthermore, since the pressure between first intermediate rolls 13 and the idler roll 14 is a little lower in these gap areas than elsewhere along the roll 14, there is minimum tendency for these areas to mark the first intermediate rolls 13.

Figure 14:
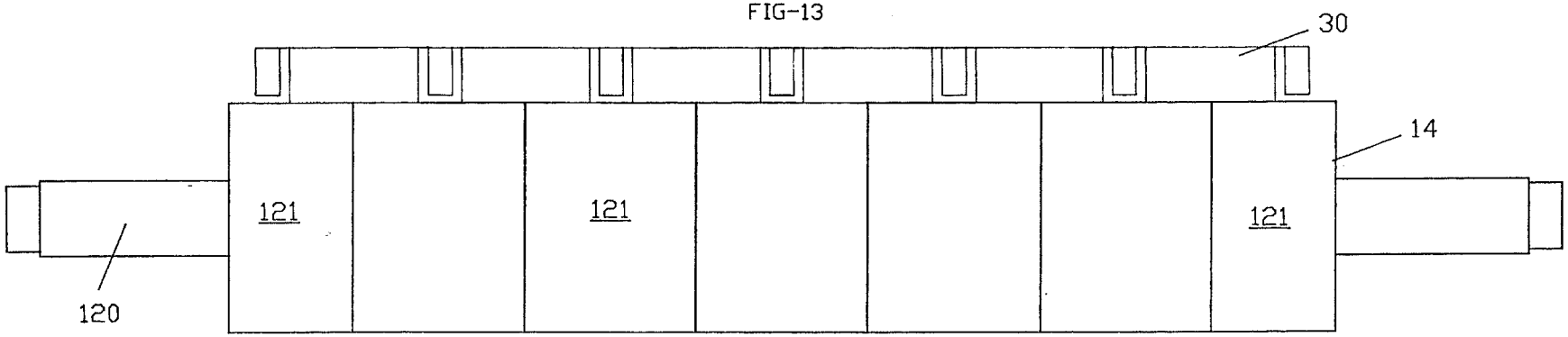
FIG. 14 is a fragmentary, elevational view of a backing assembly and a second embodiment of a second intermediate idler roll according to the invention.

In another embodiment the rings are located to provide gaps in line with the center lines of the B and C bearings 30, as shown in the lower half of FIG. 12 and in FIG. 14. This arrangement has the advantage that the less radially stiff portions (i.e. the gap portions) of the idler roll 14 are in line with the stiffer portions (i.e. the bearing portions) of the backing assemblies B and C, and the stiffer portions (i.e. the center portions of rings 121) are in line with the less radially stiff portions (i.e. the saddle portions) of the backing assemblies B and C. Thus there is a cancellation effect which produces minimum variation in stiffness of the structure consisting of idler roll 14 and B and C backing assemblies (i.e. the radial stiffness across the mill is more uniform).

Depending upon whether minimizing roll marking or maximizing uniformity of stiffness is more important in a given application, either the embodiment of FIG. 13 or the embodiment of FIG. 14 could be adopted.

Figures 15, 16, 17:
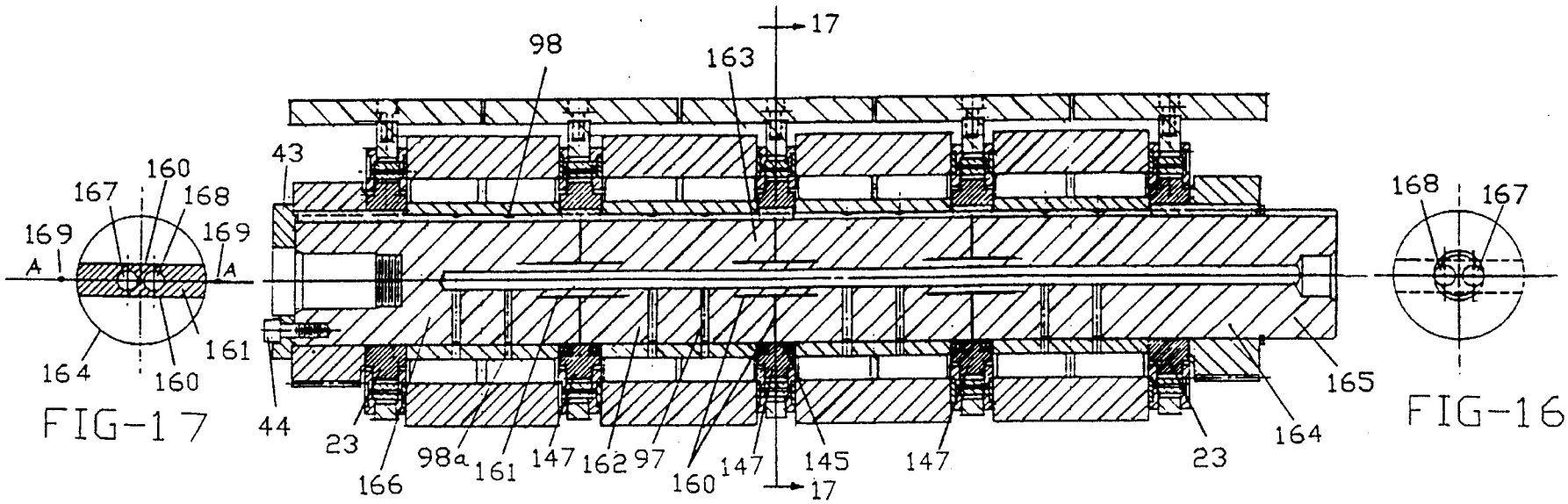
FIG. 15 is a longitudinal, cross sectional view of another embodiment of the backing assembly of the present invention.
FIG. 16 is an end elevational view of the shaft of FIG. 15, as seen from the right of FIG. 15.
FIG. 17 is a cross sectional view of the shaft taken along section line 17– 17 of FIG. 15.

A final embodiment of a backing assembly according to the present invention is illustrated in FIGS. 15, 16 and 17. In this embodiment, the backing assembly comprises a shaft 164 having overall dimensions similar to those of the prior art shaft 18 of FIG. 4. The shaft 164 is provided with pairs of opposed, transversely extending, T-shaped slots 160. The width of the slots 160 is not critical. Excellent results have been achieved with slots having a width falling within the range of from about 0.01 inch to about 0.02 inch. The slots 160 can be made in the shaft 164 in any appropriate manner, as for example by the machining process known as "WIRE EDM" (i.e. electrical discharge machining using a wire electrode). As is evident from FIG. 15, the pairs of T-shaped slots 160 are located at each saddle, except the endmost saddles.

As is evident from FIG. 15, the slots 160 define boundaries of different zones within the shaft 164. First of all, there are the zones 161 which are formed between the T-shaped slots 160 of each pair thereof (see also FIG. 17). The zones 161 form relatively narrow flexible members. The pairs of T-shaped slots 160 also define bridge zones 162 and those portions 163 of bridge zones 162 which support the bridge zones in eccentrics 147, and which form rigid bridges upon which the bearings 30 are mounted. The slots 160 also define boundaries of end zones 165 and 166 of shaft 164. Each of the end zones 165 and 166 is supported in one eccentric 23 and one eccentric 147, and each end zone 165 and 166 forms a rigid bridge on which a roller bearing 30 is mounted. The eccentrics 23 and 147 are respectively identical to those of the same index numerals appearing in the embodiment of FIG. 10. As will be apparent from FIG. 15, the leaves 161 also form flexible tie means which tie all of the bridges 162, 165 and 166 together. Thus, it can be seen, by cutting slots 160 in shaft 164, segmented bridge means 162, 165 and 166 are formed in the shaft, and flexible tie means consisting of leaves 161 are formed by the same cuts 160.

Lubrication is provided from one end of shaft 164 by a pair of longitudinally extending bores 167 and 168. The bores 167 and 168 are smaller in diameter and are provided in place of a single larger bore used in prior art designs, and in other embodiments of the present invention. The two smaller bores are used in order to be able to pass through the center of leaves 161, thereby permitting the leaves 161 to be as slender (and hence as flexible) as possible, while still providing sufficient flow area to enable the required oil volume to flow to the bearings 30. As in other embodiments herein described, radial oil holes are used to deliver the oil from the bores 167 and 168 to circumferential grooves 98 formed in the outside surface of the shaft, from which the oil can flow into the bearings 30 via radial holes **98*a*** in the bearing inner rings.

As in the embodiment of FIG. 10, spacing means in the form of springs 145 are located within pockets of the central eccentrics 147, which are about 0.5 mm narrower than the end eccentrics 23. When the assembly is completed by tightening bolts 44 on clamp plate 43, the springs 145 will ensure that a clearance of about 0.25 mm exists on each side of each central eccentric 147, thus providing a flexible spacing means between the sides of the inner ring of each bearing 30 and the adjacent eccentrics 147.

It would be within the scope of the present invention to provide each eccentric 147 with dowel-like button spacers together with or in lieu of springs 145. Each dowel-like spacer button would have a length of about 0.5 nun and would be mounted in its respective pocket in its respective eccentric 147 with the exposed end of the dowel-like button being rounded. Each eccentric 147 would be provided with four such dowel-like buttons, two on each side of the eccentric. The dowel-like buttons on each side are diametrically located and all four buttons of each eccentric 147 would lie in a plane A—A (see FIG. 17) passing through the longitudinal axis of shaft 164 and parallel to the cross portions of the adjacent set of opposed T-shaped slots. Two such dowel-like buttons are diagramatically indicated at 169 in FIG. 17. The four buttons of each eccentric 147 contact the inner rings of the bearings adjacent that eccentric 147.

It is also possible to provide profile adjustment on the F and G assemblies of a 20-high cluster mill. This has not been done in the art because of the difficulty in accessing the profile adjustment drives which would have to be underneath the mill housing. In co-pending application Ser. No. 07/916,909, filed Jul. 20, 1992, in the names of Michael G. Sendzimir, John M. Turley, and Alexander Datzuk, and entitled ADDITIONAL PROFILE CONTROL FOR CLUSTER MILLS, that problem is addressed and a novel solution to it is taught.

Because the F and G assemblies are normally used for pass line height adjustment only, the saddles are "plain" (i.e. they incorporate no rollers). To achieve crown adjustment on these saddles, in one embodiment of the above noted co-pending application, saddle assemblies similar to those on B and C shafts (i.e. incorporating eccentric rings used for profile adjustment) are provided, but rollers 33 and 37 are omitted, and eccentric ring 23 is made suitably thicker, so it fits directly between saddle ring 31 and eccentric 23.

In such a case, the saddles are "self locking" (i.e. neither the eccentric ring nor the eccentric will rotate under load), because the friction on their sliding surfaces is too high. In such a case, adjustment of pass line height by rotating of eccentrics and shaft or shaft sections by means of gears 22, and adjustment of profile by rotation of individual eccentric rings 23 by means of racks 41 can only be achieved under no load conditions (i.e. when there is no roll separating force or there is "daylight" between the two work rolls 12). Although this represents no problem regarding pass line adjustment, it does limit the versatility of the profile adjustment which is ideally adjustable under load. However, if a 20-high cluster mill is also provided with profile adjustment at B and C assemblies according to one of the above embodiments, which are capable of adjustment under load by virtue of the roller saddles, then the profile adjustment on the F and G assemblies can be used to preset the profile before rolling and that on the B and C assemblies can be used just to trim the profile during rolling.

The advantage of this arrangement is not only that the total range of profile adjustment is doubled, but because the pass line adjustment is only carried out under no load, the torque required to rotate the shaft or shaft sections and eccentrics is very small. Therefore the embodiment for the F and G assemblies could be similar to the embodiment of FIG. 6 or that of FIG. 7 where a very small diameter and therefore highly flexible central shaft is adopted. Alternatively, if the embodiment for the F and G assemblies is similar to that of FIG. 9, the friction between dowels 103 and shafts 101, 102 (proportional to torque) is very low as the adjustment is only carried out under no load. Therefore the ability to adjust the profile of F and G assemblies measured in terms of the amount of curvature that can be generated in the adjacent idler roll can be greater than the corresponding ability to adjust the profile of B and C assemblies, where the ability is limited by the necessity to transmit torque through the assembly from screwdown gears to eccentrics to effect the screwdown during rolling.

Materials used for all the shafts, and cores described above are traditionally hardened alloy steels. It is also possible to achieve increased flexibility of shafts or cores by making them of a material with a lower elastic modulus, such as aluminum alloy or non-metallic composites. The embodiments described can also be realized in such materials.

What is claimed:

1. A crown adjustment system for a 20-high (1-2-3-4) cluster mill having a mill housing with a roll cavity containing upper and lower clusters, each of said clusters comprising a work roll, two first intermediate rolls, three second intermediate rolls, and four backing bearing assemblies, said second intermediate rolls of each cluster comprising an inner idler roll and two outer driven rolls, said mill housing having an operator's side and a drive side, said upper cluster backing bearing assemblies being designated A through D and said lower cluster backing bearing assemblies being designated E through H in a clockwise fashion as viewed from said operator's side, each backing bearing assembly comprising a shaft mounting a pair of endmost load supporting bearings and a plurality of intermediate load supporting bearings, each bearing comprising an inner ring, an outer ring and rollers therebetween, each bearing having a middle portion and terminating in sides, said shaft supporting a plurality of eccentrics between which said bearings are mounted, said eccentrics being non-rotatable with respect to said shaft, said shaft being supported against said mill housing by saddle assemblies equal in number to said eccentrics, each saddle assembly comprising a saddle shoe supporting a saddle ring within which one of said eccentrics is rotatably mounted, said saddle assemblies of at least one of said upper cluster B–C pair of backing bearing assemblies and said lower cluster F–G pair of backing bearing assemblies being provided with crown adjustment means for bending the shafts thereof, said at least one pair of backing bearing assemblies used for crown control profile adjustment each having segmented bridge means for transferring said load from said middle portion to said sides of each of the bearings thereof, said backing bearing assemblies of said at least one pair each having flexible spacing means between said eccentrics and said inner rings of said bearings thereon, and said backing bearing assemblies of said at least one pair each having flexible tie means for tying said bearings, eccentrics, bridge means and spacing means together.

2. The crown adjustment system claimed in claim 1 wherein said inner idler roll of said second intermediate rolls, located adjacent said at least one pair of backing bearing assemblies, comprises a solid, rod-like, transversely flexible core, a series of hardened rings mounted on said core with narrow gaps between adjacent rings, said rings each having an axial length, said rings contacting said core for less than said axial length of said rings by virtue of one of counter bores in said rings and annular recesses in said core.

3. The crown adjustment system claimed in claim 2 wherein said rings are affixed to said rod-like core by heat shrinking.

4. The crown adjustment system claimed in claim 2 wherein said rod-like core is threaded at both ends and provided with nuts, said rings being installed with a slip fit on said core, a resilient spacer located between each ring, said spacer being chosen from the class consisting of a wave washer and a disc spring, said gap between said rings being determined by tightening of said nuts.

5. The crown adjustment system claimed in claim 2 wherein said bearings of said backing bearing assemblies of said at least one pair have center lines, said gaps between rings are aligned with said center lines.

6. The crown adjustment system claimed in claim 2 wherein said gaps between said rings are aligned with the saddle assemblies of said backing bearing assemblies of said at least one pair.

7. The crown adjustment system claimed in claim 1 wherein each of said backing bearing assemblies of said at least one pair has resilient spacers mounted between each side of each bearing inner ring and the adjacent eccentric, said resilient spacers being chosen from the class consisting of O-rings, wave washers and disc springs, each bearing inner ring having an annular recess in an inner surface thereof forming extended supporting edge portions thereon, each eccentric being mounted on and non-rotatively affixed to a mounting ring on said backing bearing assembly shaft, each mounting ring extending to either side of said eccentric thereon and supporting an extended supporting edge portion of the adjacent bearing inner ring, each mounting ring being keyed to said shaft with said eccentric thereon in phase, means being provided to prevent rotation of the inner ring of each bearing about said shaft, each bearing having the same outside diameter, a pair of screwdown gears each keyed in phase to said shaft near an end thereof, said shaft having a diameter less than one half the norm, said norm being from about 44% to about 46% of said outside diameter of said bearings.

8. The crown adjustment system claimed in claim 7 wherein each eccentric and adjacent mounting ring comprise an integral, one-piece structure.

9. The crown adjustment system claimed in claim 7 wherein said bearing inner rings are each pinned to an adjacent one of said eccentrics to prevent rotation of said bearing inner rings about said backing bearing shaft.

10. The crown adjustment system claimed in claim 7 wherein said backing bearing shaft has an axial hole for lubricating oil at one end connecting to radial holes in said shaft, a header mounted on said shaft, said radial holes leading to and directing oil to said header, said shaft having a plurality of longitudinal grooves formed thereon, said header being connected to and directing oil to said grooves, said grooves being connected by holes in said inner bearing rings to the bearing rollers for directing said lubricating oil thereto.

11. The crown adjustment system claimed in claim 1 wherein each of said backing bearing assemblies of said at least one pair has resilient spacers mounted between each side of each bearing inner ring and the adjacent eccentric, said resilient spacers being chosen from the class consisting of O-rings, wave washers, and disc springs, each bearing inner ring having an annular recess in the inner surface thereof forming extended supporting edge portions thereon, said eccentrics and said bearing inner rings being mounted directly on said backing bearing assembly shaft, said eccentrics being keyed thereto in phase, means being provided for preventing rotation of said inner ring of each bearing about said shaft, each bearing having the same outside diameter, a pair of screwdown gears each keyed in phase to said shaft near an end thereof, said shaft having a diameter of about 70% of the norm, said norm being from about 44% to about 46% of said outside diameter of said bearings.

12. The crown adjustment system claimed in claim 11 wherein said bearing inner rings are each pinned to an adjacent one of said eccentrics to prevent rotation of said bearing inner rings about said backing bearing shaft.

13. The crown adjustment system claimed in claim 11 wherein said backing bearing shaft has an axial hole for lubricating oil at one end connecting to radial holes in said shaft, a header mounted on said shaft, said radial holes leading to and directing oil to said header, said shaft having a plurality of longitudinal grooves formed thereon, said header being connected to and directing oil to said grooves, said grooves being connected by holes in said inner bearing rings to the bearing rollers for directing said lubricating oil thereto.

14. The crown adjustment system claimed in claim 1 wherein each of said backing bearing assemblies of said at least one pair has resilient spacers mounted between each side of each bearing inner ring and the adjacent eccentric, said resilient spacers being chosen from the class consisting of O-rings, wave washers and disc springs, said backing bearing assembly shaft being divided transversely into two end sections, one under each of said endmost ones of said bearings, and intermediate sections, one under each of said intermediate bearings, each of said shaft sections having an axial bore, an elongated tube having ends with threads and nuts, said shaft sections being mounted on said tube end-to-end and being slightly spaced from each other by O-rings located therebetween when said nuts on said tube are tightened, said shaft sections also being pinned together by dowel means for torque transmission and alignment, said shaft sections having aligned keyways formed therein, said eccentrics being keyed to said shaft sections in phase and a pair of screwdown gears each keyed in phase to one of the endmost of said shaft sections, each bearing having the same outside diameter, means to prevent rotation of the inner ring of each bearing about a respective shaft section, said shaft sections having a diameter of from about 44% to about 46% of the outside diameter of said bearings.

15. The crown adjustment system claimed in claim 14 wherein each of said inner rings is pinned to said key of an adjacent one of said eccentrics to prevent rotation of said inner rings about said shaft.

16. The crown adjustment system claimed in claim 14 wherein one end of said tube is plugged and the other end of said tube is connected to a source of lubricating oil, said tube and said shaft sections having radial holes therein leading said oil to said bearings.

17. The crown adjustment system claimed in claim 1 wherein each shaft of each of said backing bearing assemblies of said at least one pair is divided transversely into two end sections each under one of said endmost bearings and intermediate sections one under each of said intermediate bearings, said shaft sections being tied together by two keys extending along substantially the entire shaft in diametrically opposed keyways in said shaft sections, said keys being bolted to a split ring affixed to said shaft near one end thereof, said keys being bolted to a retainer at the other end of said shaft, disc spring means on bolts attaching said keys to said retainer, to take up relative movement between said shaft sections and said keys, spring means being mounted in pockets in adjacent shaft section ends to provide gaps therebetween, said eccentrics and said bearings on said shaft being spaced by spring means in pockets in all but those eccentrics nearest said shaft ends, a third keyway extending the entire shaft, said eccentrics being keyed therein in phase, a pair of screwdown gears one near each end of said shaft, said screwdown gears being keyed in phase in said last mentioned keyway, means to prevent rotation of the inner ring of each bearing about a respective shaft section, each bearing having the same outside diameter, said shaft sections having a diameter of from about 44% to 46% of said outside diameter of said bearings.

18. The crown adjustment system claimed in claim 17 wherein each of said shaft sections has an axial lubrication hole, said axial holes being coaxial to form a lubrication oil passage, said passage being closed at one end, hollow sleeves fitted with O-rings sealing said gaps between said shaft sections and making said lubrication oil passage continuous, radial holes in said shaft sections connecting said oil passage to said bearings.

19. The crown adjustment system claimed in claim 1 wherein said shaft of each of said backing bearing assemblies of said at least one pair is provided with endmost eccentrics and intermediate eccentrics between said endmost eccentrics, opposed pairs of transverse T-shaped slots, centered with respect to each of said intermediate eccentrics, are formed in said shaft, each T-shaped slot of each pair has a leg portion extending transversely of said shaft and terminating within said shaft in a cross portion lying in a plane parallel to and spaced from the axis of said shaft, each leg portion of said slots of each pair lying in a transverse plane perpendicular to said shaft axis, said cross portions of each of said slots lying in parallel planes to either side of said shaft axis, said cross portions of each opposed slot pair define between them a zone of said shaft comprising a flexible leaf member, adjacent pairs of opposed slots define between them bridge zones with portions which support the bridge zones in each of those eccentrics aligned with one of said slot pairs, said bridge zones constituting ridged bridges upon which said intermediate bearings are mounted, said shaft having ends, those slot pairs nearest said ends of said shaft also defining end zones of said shaft, each of said end zones being supported in one of said endmost eccentrics and the adjacent one of said intermediate eccentrics, each of said end zones forming a rigid bridge to support one of said endmost bearings, said flexible leaf members comprising flexible tie means tying said bridges together.

20. The crown adjustment system claimed in claim 19 including a pair of bores in side-by-side relationship extending longitudinally from one of said shaft ends and terminating short of said other shaft end, said bores being connected to a lubricant source, said shaft having a peripheral surface, said longitudinal bores having radial bores leading to annular grooves formed on said peripheral surface of said shaft, said inner rings of said bearings having radial bores communicating with said grooves, said longitudinal bores pass through said flexible leaf members, said longitudinal bores having a diameter sufficient to provide adequate lubricant flow and small enough to permit said leaf members to be as slender and flexible as possible.

21. The crown adjustment system claimed in claim 19 wherein said shaft has a longitudinal axis, each of said intermediate eccentrics is provided with a pair of dowel-like spacers mounted diametrically opposite each other on each side of said eccentric, each of said dowel-like spacers is mounted in a recess in said eccentric and has a rounded nose portion extending from said recess and contacting the inner ring of the adjacent one of said bearings, said dowel-like spacers of each side of each intermediate eccentric having axes located in a plane passing through said longitudinal axis of said shaft and parallel to said cross portions of said T-shaped slots when said shaft longitudinal axis is rectilinear.

* * * * *